United States Patent [19]

Batchelder, III et al.

[11] Patent Number: 4,717,202

[45] Date of Patent: Jan. 5, 1988

[54] OUTDOOR COURTESY BENCH

[75] Inventors: Joseph H. Batchelder, III; John M. Parks, both of Peoria, Ill.

[73] Assignee: The Batchelder Company, Peoria, Ill.

[21] Appl. No.: 915,579

[22] Filed: Oct. 6, 1986

[51] Int. Cl.[4] ..... A47C 7/62

[52] U.S. Cl. ..... 297/191; 297/182; 297/193; 297/457; 297/DIG. 2; 297/452

[58] Field of Search ..... 297/457, 452, 248, 191, 297/182, 217, DIG. 2, 192, 193

[56] References Cited

U.S. PATENT DOCUMENTS

| | | | |
|---|---|---|---|
| 1,639,085 | 8/1927 | Fohey | 297/191 |
| 2,400,167 | 5/1946 | Resnick | 297/182 |
| 2,711,786 | 6/1955 | Weiss | 297/457 R |
| 3,006,689 | 10/1961 | Eppink | 297/457 |
| 3,230,007 | 1/1966 | Spangler et al. | 297/457 |
| 3,482,874 | 12/1969 | Henebry et al. | 297/452 |
| 3,531,157 | 9/1970 | Duckett et al. | 297/248 |
| 3,697,129 | 10/1972 | Sklaar | 297/182 |

*Primary Examiner*—Francis K. Zugel
*Attorney, Agent, or Firm*—Ralph E. Walters

[57] ABSTRACT

The present invention relates to an outdoor courtesy bench and is specifically concerned with providing such a bench which is constructed of a lightweight easily handled material for visibly displaying a plurality of advertising panels, both on the front and back of the bench. Prior art devices have been constructed of heavy, high maintenance materials which in use are subject to the accumulation of debris and the like therebeneath and which are subject to the collection of rain water and the like on the seat portion thereof and have only been adaptable to display a single advertising panel on the frontside thereof. The present invention overcomes these deficiencies by providing an outdoor courtesy bench of three-piece modular construction of a lightweight material having a hollow base portion to which discreet weight members can be added for increased weight and stability of the bench after positioning at a selected bench site. The base completely covers the ground area on which it is disposed thereby eliminating any space beneath the bench thus precluding the accumulation of any debris under the bench and provides a channeled upper seat portion which effectively disperses any rain water therefrom to prevent puddling or any accumulation of such water on the seat for fast drying and convenient use of the bench in all weather conditions.

6 Claims, 5 Drawing Figures

62
14
64
52
53
53

78
77
12
56
51
46
76
72
55
78
77
43
43
77
39
32
72
23
76
11
33
34
10

OUTDOOR COURTESY BENCH

TECHNICAL FIELD

The present invention generally relates to an outdoor courtesy bench for use at public bus stops, parks, malls, and other high traffic locations and more particularly to such a bench which is adapted to interchangeably mount a variety of commercial advertising message panels in high visable position thereon.

BACKGROUND ART

Traditionally, outdoor courtesy benches have been constructed of a number of components usually manufactured primarily from wood and concrete. The use of these widely dissimilar materials has made it difficult to initially join such components in a dependably sturdy assembly and have been inconvenient and quite expensive to maintain in a manner assuring the preservation of their desirably attractive appearance for any appreciable length of time. Such prior art benches usually include a pair of spaced endwardly disposed support legs formed of heavy precast concrete individually having opposite front and rear ground engaging foot portions and rearwardly disposed upwardly extended back support portions. A plurality of wooden seat boards or slats are mounted in closely spaced bridging relation on the legs by a plurality of expansion anchors in the legs adapted to receive a number of lag bolts or the like extended through the seat boards. Frequently, a decorative face board is disposed on the front of the legs below the seat boards and secured in a similar manner to afford additional strength and support for the forward most overhanging seat board. A large heavy advertising panel or backboard of solid wood is similarly directly secured to the front surfaces of the back support portion of the legs to serve as a back rest for persons sitting on the bench. Because of the substantial overall weight of such benches, they are extremely difficult to handle during assembly and to transport to the bench site and are equally difficult to manuever even when only slight adjustments are necessary during the final positioning operation at the site. Another problem has developed in that such benches are highly subject to damage from vandalism. It has been found that if a sufficiently strong rearwardly directed force is applied to the top of the back rest, the bench can be tipped over with damaging consequences. While the benches are normally relatively stable in ordinary use, the susceptibility to tipping is greatly enhanced by the substantial concentration of weight in the upper back support portions of the heavy concrete legs.

Other problems experienced with the prior art benches include the need for periodic maintenance, including frequent painting to maintain an attractive appearance and to prevent rotting of the wooden seat boards, the patching of cracks and chips in the concrete legs and other adverse effects from normal wear and tear, notwithstanding the occurrence of any normally anticipated less destructive types of vandalism than described above. Furthermore, the bench site must also be maintained which requires the cutting of weeds, grass, and the removal of trash, snow and other unsightly extraneous matter from around and particularly under the bench. Another disadvantage with this type of prior art bench is the inability to utilize the backside of the advertising panel because of the large concrete back support portions of the legs which substantially obscure a relatively large area of the surface.

Some of the above described problems have been partially overcome by a second generation outdoor courtesy bench presently in use which is substantially of the same configuration as that described above but which utilizes a lighter weight fiberglass material for the several bench components. The legs of such second generation bench are formed of a hollow one piece construction and have an integral back support portion which are open at the front for filling the interior of the legs with a loose granular weighting material such as sand. A substantially flat impervious seat portion of the same fiberglass material is mounted on top of the legs which has a tendency to collect and retain rain water thereon. This is not only uncomfortable for persons wanting to sit on the bench but after puddling and drying leaves unsightly rings or stains which are very difficult to remove. An expensive aluminum frame which frequently presents a number of hazardous sharp edges is mounted on a heavy solid wood backing panel which is secured to the back support portions of the legs. The panel and frame assembly is adapted to hold a lightweight polystyrene advertising panel which can be changed by removing at least a top segment of the aluminum frame from the wooden backing panel. Again, the backside of the backing panel of the bench is useless for carrying an advertising message thereon because the large back support members of the legs obscure a substantial portion of the back surface of the bench. Furthermore, before transporting the bench to another site, the loose sand, weighing hundreds of pounds, must be dumped out of the legs and somehow retrieved and placed in smaller containers that can be easily lifted and transported to the next bench site. Dumping of the sand is difficult to accomplish without scattering a substantial portion thereof around the former bench site, making clean up difficult and usually resulting in substantial contamination of the sand, rendering it unfit for further use. The second generation bench also has the same problem of being susceptible to the accumulation of debris, snow and the like beneath the bench. It is therefore recognized that an improved outdoor courtesy bench is desirable which is more lightweight, easily assembled, conveniently transportable and substantially more stable than heretofore provided by the prior art benches. Accordingly, the present invention is directed to overcoming all of the problems as set forth above.

DISCLOSURE OF THE INVENTION

In accordance with one aspect of the present invention, there is provided an outdoor courtesy bench which utilizes a three-piece modular construction with all components being manufactured from the same lightweight material providing a hollow base having an upstanding rear panel support member with the base adapted to substantially cover the entire area beneath the bench; a seat and front panel support member mounted on top of the base with the front panel support member overlapping the rear panel support member and forming a backrest for the bench with the seat being channeled to quickly drain off any accumulation of rain water or the like; and a cap member disposed in covering relation to the upstanding front and rear panel support members for dependably locking the three components in rigidly interconnecting relation for interchangeably supporting an advertising panel on both the front and back surfaces of the bench.

BEST MODE FOR CARRYING OUT THE INVENTION

Figure 1:
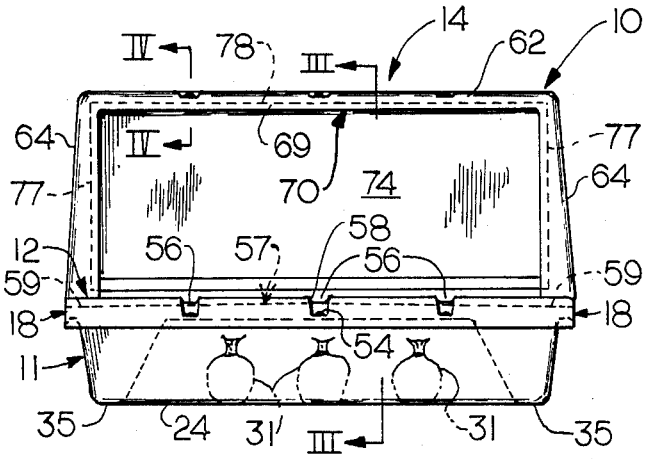
FIG. 1 is a front elevational view of the outdoor courtesy bench of the present invention.
Figure 2:
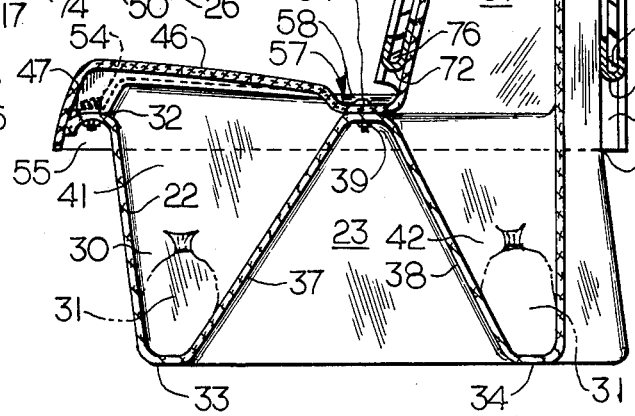
FIG. 2 is an end elevational view of the outdoor courtesy bench of FIG. 1.
Figure 5:
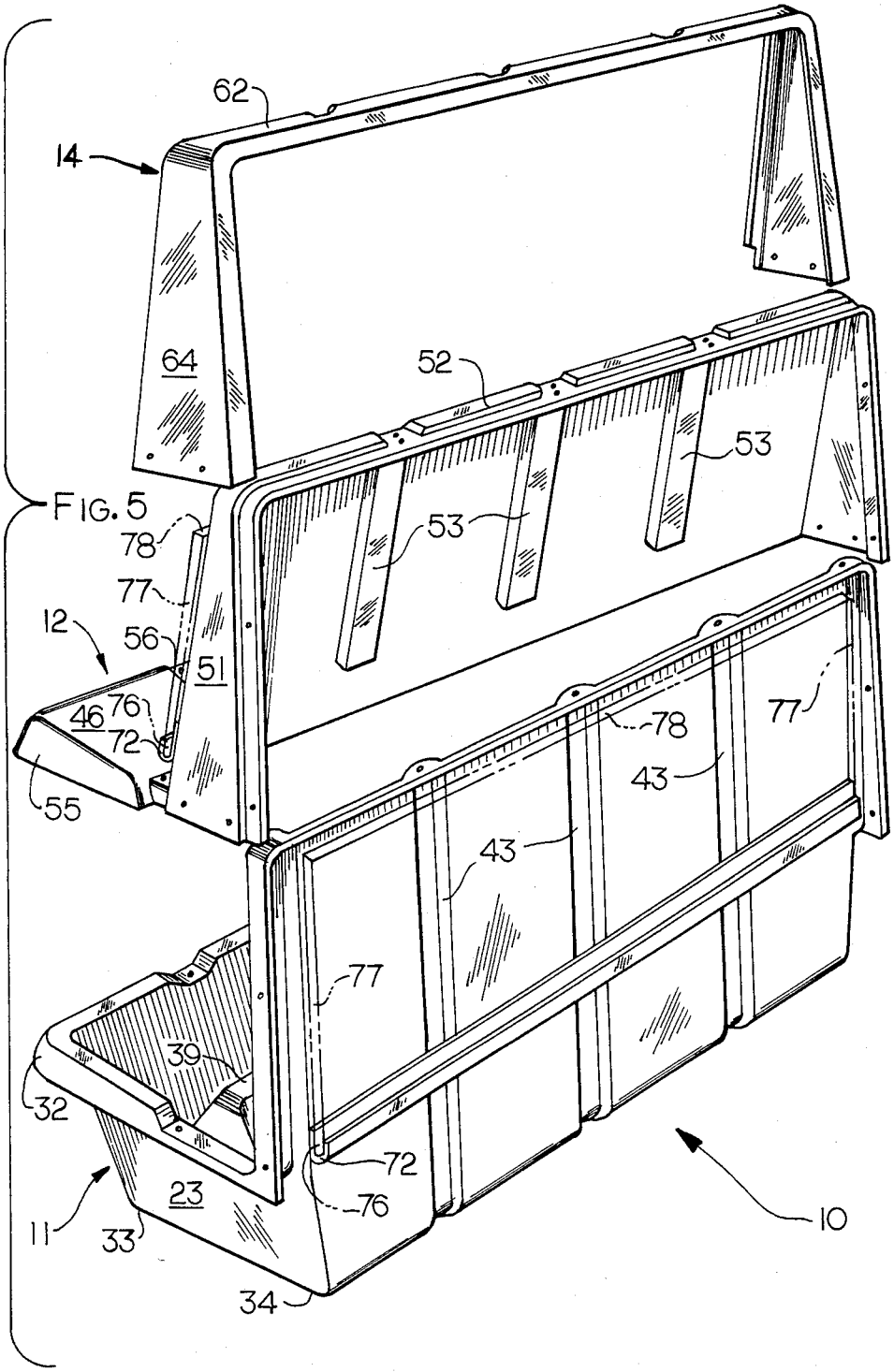
FIG. 5 is an exploded three-dimensional view of the three major segments of the outdoor courtesy bench of the present invention shown prior to assembly.

Referring more particularly to FIGS. 1, 2 and 5 of the drawings, an outdoor courtesy bench generally indicated by the reference numeral 10 and embodying the principles of present invention is provided having three major segments all preferably manufactured of light-weight molded fiberglass sheet material, including a hollow base and rear advertising panel mounting portion 11, a seat and front advertising panel mounting portion 12, and a removable cap 14 for locking all three segments together in one integrated assembly. The bench 10 generally provides a front 16, a back 17 and opposite ends 18. The front advertising panel mounting portion of the seat 12 is rearwardly upwardly extended to serve as a backrest 20 for the bench.

The first segment or base 11 of the bench 10 is molded into a one piece integral structure providing a front wall 22, opposite end walls 23, bottom walls 24, and an upstanding continuous rear advertising panel support wall 26. The rear panel support wall includes a marginally disposed rearwardly turned bolting strip 27 along the ends and top thereof for a purpose soon hereinafter to be described. The front, rear, end and bottom walls of the base circumscribe an elongated substantially rectangular interior compartment 30 which is upwardly opening for free ingress thereto prior to assembly of the other aforementioned major segments of the bench. A plurality of discreet weight members such as sand bags, identified by the reference numeral 31, are adapted to be loosely received within the compartment 30.

The front wall 22 of the base 11 has an upper forwardly-endwardly extended front flange 32 while the bottom wall 24 provides a pair of front and rear ground engaging foot portions 33 and 34, respectively. The bottom wall 24 further continues along the opposite end walls 23 of the base 11 to form continuous opposite end foot portions 35. A pair of interior walls 37 and 38, respectfully, extend from their associated foot portions 33 and 34 in upwardly converging relation and terminate in a top seat support wall portion 39 in substantially frusto-pyramidal configuration in cross section with the top wall being disposed in substantially elevationally coplaner relation with the upper front flange 32 of the front wall 22. The interior walls 37 and 38 effectively divide the compartment 30 into front and rear sections 40 and 41, respectively. A plurality of longitudinally spaced vertically extended ribbed channels 43 are integrally formed in the rear panel support wall 26 for added strength and to provide clearance for suitable fasteners hereinafter to be described.

Figure 3:
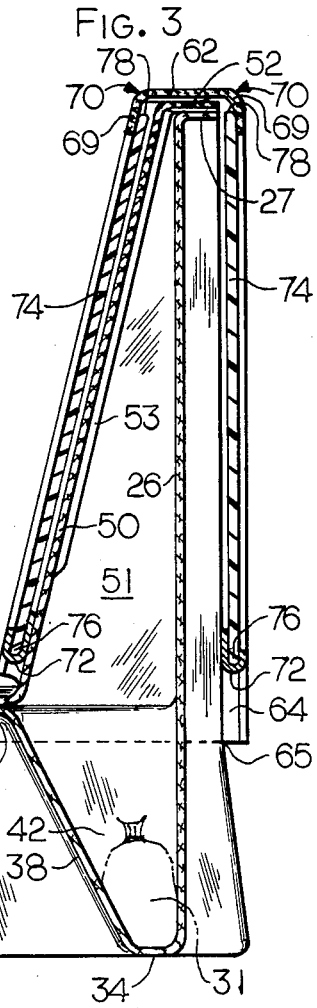
FIG. 3 is a somewhat enlarged transverse vertical section through the bench taken generally along the line III—III of FIG. 1.
Figure 4:
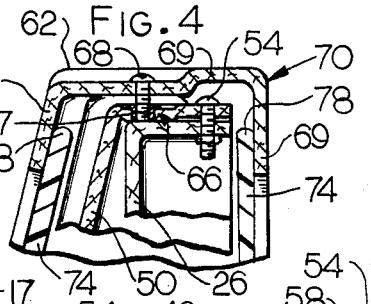
FIG. 4 is a further enlarged transverse vertical section through the upper backrest portion of the bench taken generally along the line IV—IV of FIG. 1.
Figure 4:
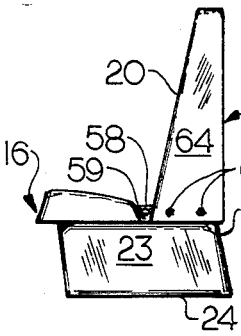

The second major segment or seat and backrest portions 12 and 20 includes a forwardly disposed upper rearwardly downwardly arcuately curved seat surface 46 having a lower interior ledge 47 for resting upon the upper front and end flange 32 of the base 11. The seat further includes a rearwardly disposed substantially upstanding front panel support wall 50 having opposite end walls 51 which are upwardly somewhat rearwardly angularly extended to terminate in a rearwardly extended bolting strip of flange 52 which, as shown in FIG. 3, is adapted to intimately overlie the bolting strip 27 of the base 11. A plurality of longitudinally spaced vertically extending ribbed channels 53 are integrally formed in the front panel support wall 50 for added strength. A plurality of bolt and nut assemblies 54 are adapted to be extended through the bolting strips 27 and 52 and between the seat 12 and flange 32 in tightly locking relation between the first and second segments of the bench.

The seat 12 further includes a front and end skirt 55 extending downwardly in overhanging relation to the upper flange 32 of the base. A plurality of rain channels 56 are integrally formed in the seat in longitudinally spaced relation thereon for added strength and to also form the interior ledge 47 as previously described. Each of the channels open into a rearwardly disposed rain trough 57 which has a centrally disposed apex portion 58 and opposite sloping ends 59 opening outwardly from the seat at the opposite ends 18 of the bench.

The third segment or cap portion 14 of the bench 10 includes an elongated substantially narrow upper wall 62 having continuous opposite depending end leg portions 64 having lower edges 65 disposed in substantially horizontally aligned relation with the lower edge of the skirt 55 of the seat. A plurality of tamper-proof lockscrew and anchor assemblies 66 are disposed in spaced locations through the upper wall and end legs securely to lock the cap in masking relation to the bolt and nut assemblies 54 through the secured front and rear upstanding panel support walls of the first and second segments dependably to retain them in assembly. Such tamper-proof lockscrew assemblies have an expandable anchor 67 mounted in the bolting strip 27 which screw-threadably receives an enlarged threaded allen-type screw 68. The screw is extendable through suitable holes in the cap 14 and is adapted to be actuated by an appropriate special tool such as an allen-type wrench, not shown, thereby rendering the assembly virtually vandal proof. The cap further includes inwardedly turned top and end flanges 69 to provide an inverted substantially U-shaped panel retaining frame 70 on both the front and back sides of the bench.

A pair of channel-like rails 72 are individually secured to the front end rear upstanding panel support members 26 and 50, respectively, by a plurality of suitable fasteners such as rivets or the like. A pair of advertising panels 74 preferably formed of a light-weight polystyrene material provide lower edges 76 which are receivable in the channular rails 72. The advertising panels also include opposite ends 77 and an upper top edge 78 with the panels being adapted to rest flatly against their respectively associated upstanding panel support members with the top and end edges being readily captured in tightly clamping relation by the flanged panel retaining frame 70 of the cap 14.

INDUSTRIAL APPLICABILITY

The outdoor courtesy bench 10 of the present invention is manufactured in the three major segments shown in FIG. 5 consisting of the base 11, the seat 12 and the removable cap 14. After transport to the appropriate bench site, the base 11 is deposited on the available support surface such as a sidewalk or other proximate ground area with the base being easily and precisely positionable in any desired orientation because of its lightweight structure. Any number of the sandbags 31 can then be easily and conveniently loaded into selected areas of the front and rear sections 40 and 41 of the compartment 30 for providing optimum stability of the later assembled bench. The sandbags usually weight about forty pounds each with the compartment holding up to approximately twenty-five bags totalling about one thousand pounds.

The second segment or seat 12 is then mounted on the base 11 in precisely overlying retention and in covering position with respect to the compartment 30. The plurality of bolt and nut assemblies 54 are then extended through the overlapping bolting flange portions 27 and 52 of the panel support walls 26 and 50 and between the seat 12 and front flange 32 and firmly locked in place. The desired advertising panels 74 are then installed with their lower edges 76 being receivable in the channular rails 72 and rested against their associated upstanding panel support walls 26 and 50 of the seat and base.

The third segment or locking cap 14 is then installed over the bolt and nut assemblies 54 of the joined panel suport walls 26 and 50. The tamper-proof fasteners 67 are then actuated to tightly clamp the locking cap in place in completely masking relation to the bolt and nut assemblies 54 thereby rendering the bench virtually vandal proof. It will be noted that the inwardly turned flanges 69 of the cap are disposed in tightly clamping relation to the upper and end edges of the advertising panels 74 while at the same time preventing any access to the bolt and nut assemblies 54 holding the first two segments in their desired assembled relation.

When it is desired to move the bench 10 to a new location, the tamper-proof fasteners 67 are removed from the top and ends of the cap 14. Such removal of the cap make the advertising panels 74 freely accessible for lifting them from their respective channular rails 72. The bolt and nut assemblies 54 are then exposed for removal from the upstanding front and rear panel support walls 26 and 50 of the seat and base to permit convenient lifting of the seat 12 from the base 11. Such removal opens the compartment 30 within the base to provide free access to the plurality of sandbags 31 which can be easily individually removed for convenient handling of the lightened base and all the components transported to the next bench site.

In view of the foregoing, it is readily apparent that the present invention provides an improved outdoor courtesy bench with its three-piece modular construction providing ease of handling and convenient assembly of the bench into an integral unit. The base completely encloses the space beneath the bench eliminating the prior cleaning problem and its hollow construction permits the deposit of a selected number of discreet weight members such as the sandbags 31 to add weight and stability to the bench after precise positioning at the bench site. The sloping channeled seat portion effectively eliminates the collection of any rain water or the like thereon which is quickly dispelled by the drain trough 57 while the upstanding back support walls 26 and 50 enable a pair of identically proportioned full size advertising signs to be visibly displayed on both the front and back sides of the bench. Furthermore, the locking cap 14 not only covers the joint between the seat and base components but also serves as a frame for securely clamping and holding the advertising panels on the front and back sides of the bench.

We claim:

1. An outdoor courtesy bench of three-piece modular construction, comprising;

a first segment providing a base having an integral upstanding rear panel support member;

a second segment providing a seat mountable on the base and having an integral upstanding front panel support member providing a horizontal upper edge portion disposed in overlapping relation to said rear panel support member;

a plurality of fasteners extended downwardly through said upper edge portion releaseably connecting said front and rear panel support members;

a pair of interchangeable front and rear advertising panels individually initially loosely disposed against said panel mounting portions of said first and second segments;

and a third segment releaseably secured to said first and second segments providing cap means disposed on said upper edge portion in masking relation to said fasteners between the front and rear panel support members to preclude any unauthorized disassembly of the base and seat segments of the bench and also providing flanged means in peripherally overlapping relation to said front and rear advertising panels to releaseably hold them in place on the bench.

2. The outdoor courtesy bench of claim 1 wherein said base is enclosed to provide a hollow weight receiving compartment therein extending substantially the entire length of the bench.

3. The outdoor courtesy bench of claim 2 including an interior wall integrally formed within said base dividing said compartment into two major sections.

4. The outdoor courtesy bench of claim 3 wherein said interior wall has an upper portion disposed in intimately engaging supporting relation to said seat when assembled on the base.

5. The outdoor courtesy bench of claim 4 including a plurality of discreet weight members individually receivably removable from said compartment in the base and being individually selectively positionable throughout said two major sections of the compartment for optimum weight distribution and stability of the bench.

6. The outdoor courtesy bench of claim 5 including a pair of elongated channel-like support rails individually rigidly mounted on said upstanding front and rear panel support members;

a pair of advertising panels having a lower edge individually loosely receivable into an associated one of said channular support rails in substantially flat overlying relation to their respectively associated upstanding front and rear panel support members, and including opposite upper and end edges;

and said cap means including inwardly turned flanged edges disposed in overlapping clamping relation to said upper and end edges of said advertising panels providing a removable marginal frame dependably to releasably hold the advertising panels in assembly on the bench.

* * * * *